US005547189A

United States Patent [19]

Billings

[11] Patent Number: 5,547,189

[45] Date of Patent: Aug. 20, 1996

[54] GOLF CLUB AND CLUB SHAFT CONSTRUCTIONS

[76] Inventor: David P. Billings, 6432 Walnut Hill La., Dallas, Tex. 75230

[21] Appl. No.: 277,680

[22] Filed: Jul. 20, 1994

[51] Int. Cl.[6] ..... A63B 53/12; A63B 53/02; A63B 53/14

[52] U.S. Cl. ..... 473/305; 473/316; 473/313

[58] Field of Search ..... 273/80 R, 80 B, 273/81 R, 81.3, 167 R, 77 R, 80.1, 80.2, 80.6, 81.4, 81.5, 81 B, 193 R, 194 R

[56] References Cited

U.S. PATENT DOCUMENTS

| | | | |
|---|---|---|---|
| 2,934,345 | 4/1960 | Scott . | |
| 3,614,101 | 10/1971 | Hunter . | |
| 3,837,647 | 9/1974 | Jacques | 273/81 R |
| 4,067,537 | 1/1978 | Key, Jr. . | |
| 4,123,055 | 10/1978 | Brill . | |
| 4,215,860 | 8/1980 | Nakamatsu . | |
| 4,272,077 | 6/1981 | Spivey | 273/81 R |
| 4,330,126 | 5/1982 | Rumble | 273/80 R |
| 4,682,762 | 7/1987 | Lekavich | 273/80 R X |
| 5,024,438 | 6/1991 | Candow . | |
| 5,078,398 | 1/1992 | Reed et al. . | |
| 5,093,162 | 3/1992 | Fenton et al. . | |
| 5,253,868 | 10/1993 | Baumann | 273/80.2 |
| 5,255,919 | 10/1993 | Johnson | 273/80.2 |
| 5,277,423 | 1/1994 | Artus . | |
| 5,310,189 | 5/1994 | Soto | 273/78 |
| 5,316,299 | 5/1994 | Feche et al. . | |

OTHER PUBLICATIONS

Tom Delner, "Which Putter is Best for You?", Peterson's Golfing, Jun. 1994 at p. 3331.

Ed Weathers, "Equipment—The Shape of Shafts to Come", Golf Digest, Oct., 1994 at 42.

James Achenback, "Lynx Hopes Black Cat Crosses Golfer's Path", Golf Week, Dec. 10, 1994, pp. 1–30.

"Golf Digest", Magazine, 1969–Dec. issue, pp. 26–28.

*Primary Examiner*—Sebastiano Passaniti

*Attorney, Agent, or Firm*—David H. Judson

[57] ABSTRACT

A golf club shaft for use in a golf club such as a putter. The shaft preferably comprises an over-sized hollow, circular tube having an outer diameter of at least 0.75 inches along substantially its entire length.

22 Claims, 2 Drawing Sheets

GOLF CLUB AND CLUB SHAFT CONSTRUCTIONS

TECHNICAL FIELD

This invention is in the fields of golf clubs, especially putters, and is particularly directed to a golf club shaft construction providing for a golf club with desired characteristics essentially identical to prior conventional clubs, but having improved performance and uniformity of construction, cost and durability over prior, known golf clubs.

BACKGROUND OF THE INVENTION

Conventional golf putters are of known construction and use. A typical putter includes an elongated, rigid, tubular shaft having a rubber or leather grip extending downward from the upper or "butt" end of the club shaft over the upper portion thereof and having a putter head disposed at the lower or "tip" end of the club shaft. The putter head may be attached directly to the shaft or, alternatively, connected thereto by a hosel. The club shaft generally has a continuous or segmented taper from the upper end of the shaft through the lower end, with the upper end having an outer diameter thickness of no more than about 0.65 inches and the tip end having an outer diameter no greater than about 0.37 inches. In use, golfers usually putt from a crouched position by grasping the putter grip and stroking the golf ball through a firm movement of the arms across the body.

These conventional putters define the standard by which all putters must conform in order to be useful for tournament play. In particular, all putter designs used in professional or amateur tournaments must conform to the Rules of Golf published by the United States Golf Association (which acts in conjunction with other international governing bodies), and these rules require that any acceptable putter must be composed of a shaft, a grip and a club head. These parts must be fixed so that the club is one unit, and the design must not be substantially different from "traditional and customary form and make."

Such conventional shaft constructions are expensive to manufacture and require special fabrication equipment and techniques. While putters incorporating such constructions form the industry standard, there have been a surprisingly broad range of attempts to improve upon this basic design. Others have attempted to improve the performance characteristics of the putter by using new materials and manufacture techniques for the shaft itself, as exemplified by U.S. Pat. No. 5,093,162 directed to a carbon-graphite or fiberglass shaft, by providing special hand grips such as shown in U.S. Pat. No, 4,067,573, or even by changing the length and use of the putter itself. The latter approach is the so-called "pendulum style" long putter which is longer than a conventional putter and allows the golfer to putt from an upright, allegedly more stable position. Such long putters are described, for example, in U.S. Pat. No. 5,024,438 and patents cited therein. Another known device, called the 20/20 putter manufactured by Probe, has an inverted tapered shaft with the tip end outer diameter of about 0.60 inches and a butt end outer diameter of about 0.35 inches.

The goal of these devices is to promote control and accuracy during the putting stroke and to provide a more comfortable and efficient putting technique by the user. While some of these prior art devices and approaches have merit and have had some general acceptance, they do not substantially improve upon the conventional putter design.

Most require costly and complicated manufacturing techniques and/or special materials.

Therefore, it is the primary object of this invention to provide a new and improved golf club shaft construction as well as a golf club incorporating such shaft construction which exhibits improved performance, namely greater stability and improved hand/eye coordination, as compared to prior conventional golf clubs.

BRIEF SUMMARY OF THE INVENTION

Achievement of the primary object of the invention is facilitated by providing a shaft that is over-sized as compared to prior art golf club shafts and that preferably does not taper along any major portion of its length. In the preferred embodiment of the invention, the shaft has an outer diameter at its tip end of no less than about 0.75 inches (as compared to a conventional shaft having a tip end of no more than 0.37 inches).

Preferably the shaft is formed of a metal (such as aluminum) or metal alloy, graphite, steel, titanium, KEVLAR® composite, or other composite material and has an outer diameter in the range of between about 0.75 and 1.50 inches along substantially its entire length, including the upper end portion of the shaft, with the tip end outer diameter no less than about 0.75 inches. Importantly, the golf club formed from such shaft has essentially the same configuration of components and is manufactured using substantially the same assembly techniques as conventional golf clubs to thereby satisfy the "form and make" requirements of USGA Rules. Thus the inventive golf club is readily useable in organized tournament play of golf. The larger tip end creates the "over-sized" shaft, which has been found to provide greater stability as compared to existing products and designs; such improved stability enhances hand/eye coordination during the golf stroke.

Another object of the invention is to provide a simple club shaft construction that is easy and economical to manufacture without resort to specialized molds or machines.

It is a further object of the invention to provide a over-sized, preferably non-tapered club shaft construction that is useful for several different types of clubs such as a putter, a pitching wedge, a chipping wedge, an iron or even a wood. In the preferred embodiment, the inventive shaft is implemented in a putter to provide a golf club that has essentially the same configuration of components as a conventional golf putter.

It is still another object of the invention to provide a golf putter having a hollow, over-sized, non-tapered shaft that meets the "traditional and customary form and make" requirements of the U.S.G.A. Rules yet provides significant advantages over the prior art in terms of construction, cost, durability and ease of use. Preferably, the putter has a golf head attached to the over-sized shaft using a hosel that aligns the putter head center of gravity with the shaft axis. Other hosel alignments are also within the scope of the invention and, if desired, the hosel may be omitted and the putter head directly attached or formed with the shaft.

The use of a larger shaft preferably dictates that the putter grip is also larger than in conventional putter designs. The larger grip has its own incidental and important advantage of promoting the use of large muscles of the back and shoulders which provides a more consistent and reliable putting stroke.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

The present invention is preferably implemented in the context of a golf putter. This preferred embodiment of the invention, however, should not be taken by way of limitation as it is the intent of this invention that the novel shaft construction also be implemented in other clubs such as a pitching wedge, sand wedge, iron, wood and the like.

Figure 1:
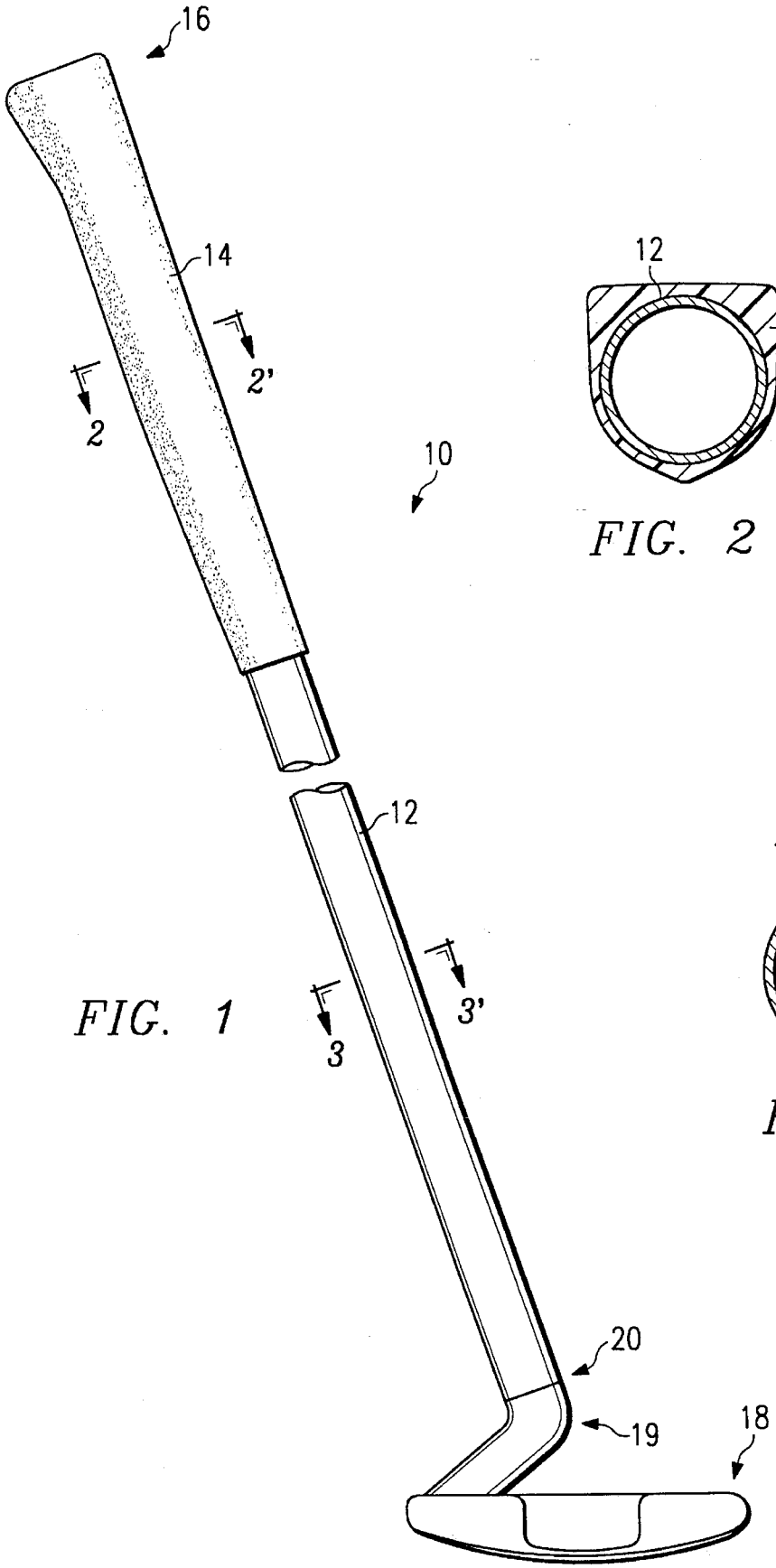
FIG. 1 is a perspective view of a golf putter incorporating the over-sized shaft of the present invention.

Referring to FIG. 1, the inventive putter 10 includes an elongated, rigid, tubular shaft 12 having a rubber, synthetic, metallic or leather grip 14 extending downward from the upper or "butt" end 16 of the club shaft over the upper portion thereof and having a putter head 18 and hosel 19 disposed at the lower or "tip" end 20 of the club shaft. The shaft 12, grip 14 and putter head 18 of the putter 10 have essentially the same configuration of components of a conventional golf putter and thus the putter satisfies the "form" requirements of USGA Rules.

Figure 4:
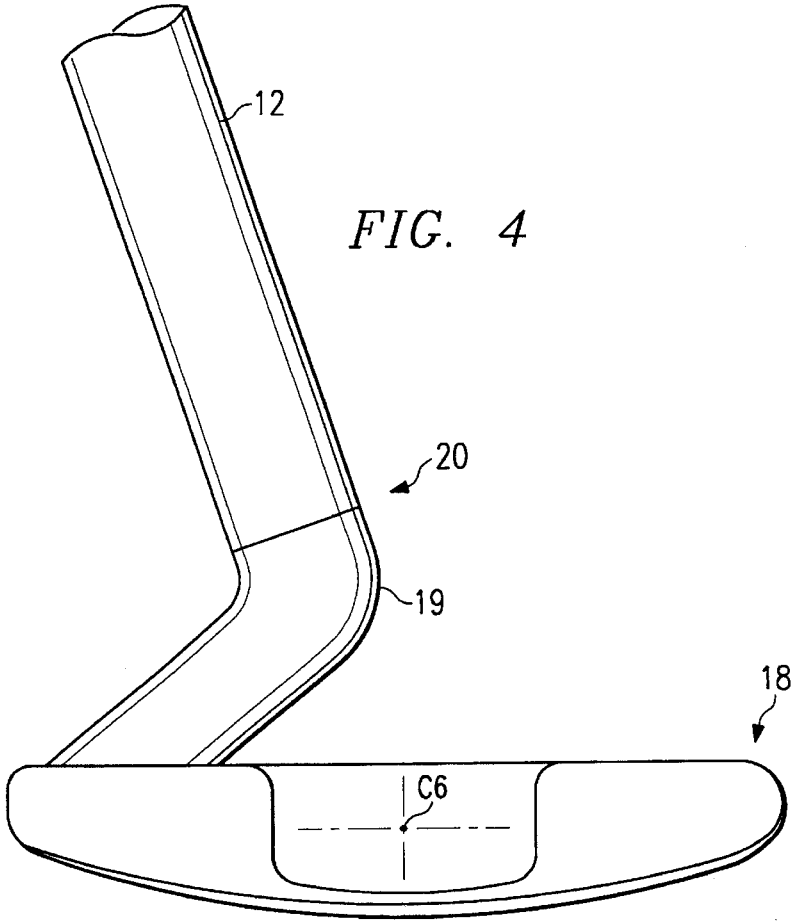
FIG. 4 is an enlarged view of the club showing the hosel and the over-sized head.
Figure 5:
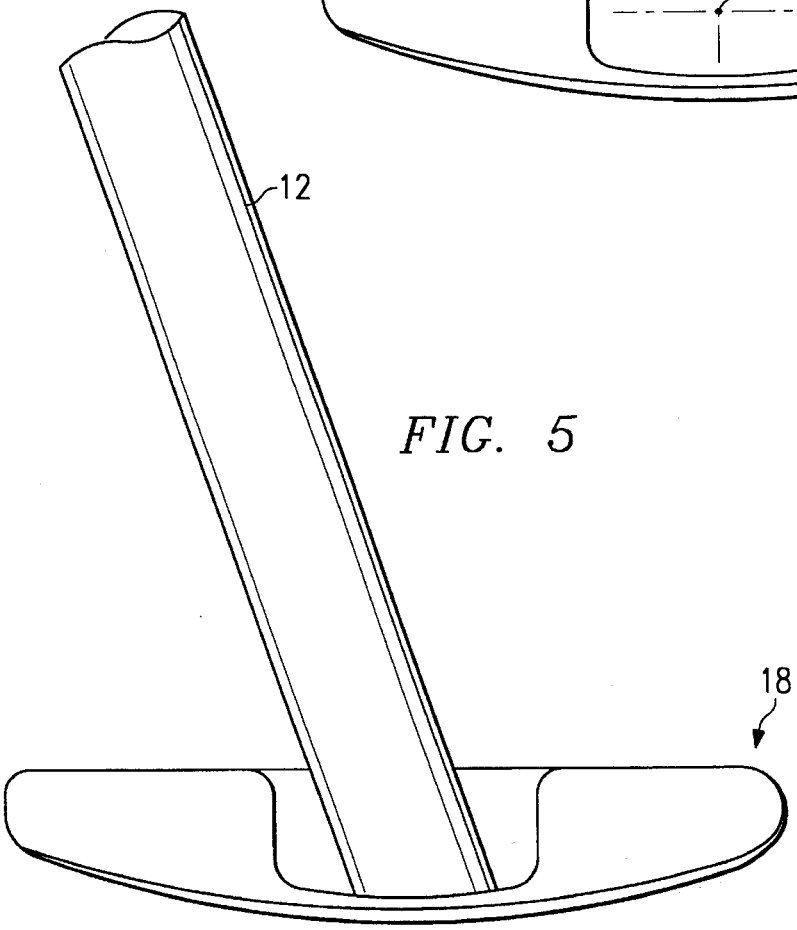
FIG. 5 is an alternative view of the club wherein the hosel is omitted and the shaft is directly attached to the head with a bore through connection.

The particular head configuration of the putter is not critical to the invention. As seen in FIG. 4, the putter head 18 is preferably attached to the over-sized shaft using the hosel 19 that aligns the putter head center of gravity (CG) with the shaft longitudinal axis. Other hosel alignments (e.g., heel-shafted) are also within the scope of the invention. Also, when the hosel is used, the putter head striking surface (i.e., the surface which strikes the ball) is preferably aligned along the leading edge of the shaft, although other leading or trailing placements of the striking face relative to the shaft leading edge (i.e., different degrees of offset or onset) are within the scope of the invention. If desired, the hosel may be omitted and the putter head directly attached or formed with the shaft as shown in FIG. 5.

Figure 2:
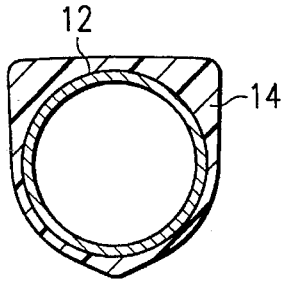
FIG. 2 is a cross-section of the grip portion of the golf club taken along line 2—2' of FIG. 1 showing the preferred construction thereof.
Figure 3:
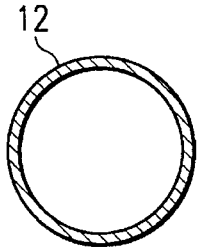
FIG. 3 is a cross-section of the over-sized shaft along line 3—3' of FIG. 1.

As seen in FIGS. 1, 2 and 3, however, unlike conventional putters, the club shaft 12 has a uniform cross-sectional area throughout substantially its entire length, and this area is "over-sized" relative to conventional prior art putters, which typically have tapered shafts having a largest outer diameter (at the butt end) of no more than 0.65 inches and a tip end outer diameter of no more than 0.37 inches. In the present invention, the shaft is preferably a hollow circular tube having an outer diameter of at least 0.75 inches along a substantial portion of its length; preferably the shaft outer diameter is at least 0.75 inches at the tip end.

Thus, unlike conventional putters with the tip end outer diameter of no more than 0.37 inches, the tip end outer diameter of the inventive shaft (and golf club) is at least about 0.75 inches. Generally, it has been found that the preferred shaft structure will have a similar outer diameter, although it is within the scope of the present invention if the shaft has a tapered appearance (provided the tip end outer diameter has the requisite size as described herein). Thus, golf clubs having an oversize tip end (at least about 0.75 inches) are deemed to be within the scope of the present invention. It has been found that golf club shafts with such dimensions provide superior stability and thus facilitate improved hand/eye coordination as compared to prior art putters of the same "form and make."

The outer diameter of the over-sized shaft is preferably may be in the range of between about 0.75 and 1.50 inches, although it should be appreciated that slight variations outside this range are also contemplated by the invention. The inner diameter of the hollow tube is between about 0.01–0.10 inches less than the outer diameter, depending on the material used. In one representative example, the material used for the shaft is 6061 grade aluminum having an outer diameter of about 1.00 inch with an inner diameter of about 0.930 inches, such that the wall thickness is 0.035 inches. The shaft is epoxied to a hosel, which itself is over-sized to receive the over-sized shaft, in a conventional process. Since the shaft and hosel are both larger than in a conventional putter, there is a larger bonding surface between the shaft tip end and the hosel, thus providing increased durability and stability during manufacture and during the use of the product. The head is preferably configured as a cavity-backed design and is over-sized as well. The grip is preferably leather with a rubber underlisting, and likewise is over-sized. While the grip is larger (due to the over-sized shaft), the amount of material is small as compared to prior art over-sized grips. The grip includes a volume of material over the butt end having a first flat portion and a second substantially V-shaped portion, as shown for example in FIG. 2. With less material, the inventive club has a more enhanced "feel" because it does not dampen the sensation of "contact" between ball and club which is necessary to help the user gauge distance. The over-sized grip, which is preferably v-shaped such as shown in FIG. 2, is accomplished with less material than is associated with the prior art, and thus does not cause the club to be weight-imbalanced, a problem associated with such over-sized grips used in the past.

Of course, the above-identified description is merely representative and is not to be taken to limit the scope of the present invention. The use of the over-sized elements provides significant stability and ease of use over prior configurations of the same "form and make".

According to the invention, the hollow shaft is preferably formed of any one of a suitable number of materials such as metal, metal alloys, lightweight steel, graphite, titanium, KEVLAR® fiber composite (available from Dupont), or other composite. Individual components of the golf club are "made" using conventional assembly techniques and manufacturing methods such that the club also satisfies the conventional "make" requirements of the USGA Rules. In this regard, the club head is preferably epoxied or otherwise fastened in a conventional manner to the shaft, and the grip is affixed to the shaft butt end. The particular manner in which the components are assembled is not part of the present invention as any conventional manufacturing and assembly techniques can be used.

Because the golf club has essentially the same configuration of components and is formed using conventional assembly techniques, the club is of the same "form and make" as conventional golf clubs, thereby enabling the product to be usable in organized tournament play in a conventional putting stance, namely, with the golfer putting from a crouched position.

The present invention promotes signficant control and accuracy during the putting stroke and provides a more comfortable and efficient putting technique. The configuration allows the user to use the same stroke as with a conventional putter, yet provides firmer control of the club head and face. The resulting club is simple and economical to manufacture and construct because of the few parts and the preferred avoidance of creating a tapered shaft with a tip end less than 0.37 inches outer diameter.

It should be appreciated by those skilled in the art that the specific embodiments disclosed above may be readily utilized as a basis for modifying or designing other structures for carrying out the same purposes of the present invention. For example, it is not always required that the shaft be hollow; under certain circumstances it may be desirable to provide a lightweight foam or other plastic resin filler material within the shaft or a portion thereof (such as adjacent the tip end) to alter the sound characteristics of the putter. It should also be realized by those skilled in the art that such equivalent constructions-do not depart from the spirit and scope of the invention as set forth in the appended claims.

What is claimed is:

1. A golf club having a shaft and a head attached to the shaft, the shaft comprising a tube having a butt end and a tip end, the shaft having substantially the same outer diameter of greater than at least 0.75 inch along its length from the butt end to the tip end and being formed of a substantially rigid material of constant wall thickness to provide stability to the shaft when the golf club is used by a golfer to strike a golf ball, wherein the shaft tip end further provides an enlarged bonding surface area for the head.

2. The golf club shaft as described in claim 1 wherein tube is hollow.

3. The golf club shaft as described in claim 1 wherein the tube is formed of a material selected from the group consisting of metals, metal alloys, graphite, steel, titanium and composites.

4. The golf club as described in claim 1 further including a volume of material formed over the butt end of the shaft to create a grip.

5. A golf club having a shaft, a head attached to the shaft, and a grip, the shaft comprising a tube formed of a substantially rigid material and having a butt end and a tip end, the tube having predetermined outer diameter dimensions, with the outer diameter at the butt end of the tube being larger than the outer diameter at the tip end of the tube such that the tube is tapered, the outer diameter at the tip end being about 0.75 inch such that the shaft tip end provides an enlarged bonding surface for the head, wherein the substantially rigid material of the tube together with said predetermined outer diameter dimensions provide stability to the shaft when the golf club is used by a golfer to strike a golf ball.

6. The golf club as described in claim 5 wherein the head is a putter.

7. The golf club as described in claim 5 wherein the head is a pitching wedge.

8. The golf club as described in claim 5 wherein the head is a chipping wedge.

9. The golf club as described in claim 5 wherein the head is an iron.

10. The golf club as described in claim 5 wherein the head is a wood.

11. The golf club as described in claim 5 wherein the tube is hollow.

12. The golf club as described in claim 5 wherein the tube is formed of a material selected from the group consisting of metals, metal alloys, graphite, steel, titanium and composites.

13. The golf club as described in claim 5 wherein the head is attached to the shaft by a hosel.

14. The golf club as described in claim 5 wherein the butt end of the shaft has a fixed outer diameter greater than 0.75 inch along a predetermined length thereof corresponding to the length of the grip, the grip including a volume of material over the butt end having a first flat portion and a second substantially V-shaped portion.

15. A putter having a shaft and a head attached to the shaft by a hosel, the shaft comprising a tube having a butt end and a tip end, the shaft having substantially the same outer diameter of greater than at least 0.75 inch along its length from the butt end to the tip end and being formed of a substantially rigid material of constant wall thickness to provide stability to the shaft when the golf club is used by a golfer to strike a golf ball, wherein the shaft tip end further provides an enlarged bonding surface area for the hosel.

16. The golf putter as described in claim 15 wherein the outer diameter of the shaft is no larger than about 1.50 inches.

17. The golf putter as described in claim 15 wherein the hosel aligns the putter head center of gravity with a longitudinal axis of the shaft.

18. The golf putter as described in claim 15 wherein the putting head has a striking surface which is aligned in a predetermined manner relative to a leading edge of the shaft.

19. A golf club having a shaft and a head attached to the shaft by a hosel, the shaft comprising a tube having a butt end and a tip end, the shaft having substantially the same outer diameter of approximately 1.00 inch along its length from the butt end to the tip end and being formed of a substantially rigid material of constant wall thickness to provide stability to the shaft when the golf club is used by a golfer to strike a golf ball, wherein the shaft tip end further provides an enlarged bonding surface area for the hosel.

20. The golf club as described in claim 19 further including a grip formed on the butt end of the shaft.

21. The golf club as described in claim 19 wherein the material is aluminum.

22. The golf club as described in claim 19 wherein the material is a graphite composite.

* * * * *